US011952193B2

(12) United States Patent
Yao et al.

(10) Patent No.: US 11,952,193 B2
(45) Date of Patent: Apr. 9, 2024

(54) LOGISTICS TRANSPORT BOX

(71) Applicant: HUNAN UNIVERSITY OF TECHNOLOGY Ltd., Zhuzhou (CN)

(72) Inventors: Jin Yao, Zhuzhou (CN); Xiao Xiao, Zhuzhou (CN); LingDan Cui, Zhuzhou (CN); Jun Lai, Zhuzhou (CN); BingQuan Zhou, Zhuzhou (CN)

(73) Assignee: HUNAN UNIVERSITY OF TECHNOLOGY LTD., Zhuzhou (CN)

( * ) Notice: Subject to any disclaimer, the term of this patent is extended or adjusted under 35 U.S.C. 154(b) by 0 days.

(21) Appl. No.: 18/124,457

(22) Filed: Mar. 21, 2023

(65) Prior Publication Data

US 2024/0025615 A1 Jan. 25, 2024

(30) Foreign Application Priority Data

Jul. 21, 2022 (CN) ..... 202210860514.9

(51) Int. Cl.
*B65D 81/07* (2006.01)

(52) U.S. Cl.
CPC ..... *B65D 81/075* (2013.01); *B65D 2581/056* (2013.01)

(58) Field of Classification Search
CPC . B65D 81/07; B65D 81/075; B65D 2581/056
USPC ..... 206/521, 583, 591–594
See application file for complete search history.

(56) References Cited

FOREIGN PATENT DOCUMENTS

CN 211643018 U * 10/2020
CN 213650442 U * 7/2021

* cited by examiner

*Primary Examiner* — Bryon P Gehman
(74) *Attorney, Agent, or Firm* — Zhigang Ma

(57) ABSTRACT

A logistics transport box is provided, and it relates to the technical field of packaging boxes. The logistics transport box includes a box body, a placement assembly, and an installation assembly. The installation assembly includes support components and sliding vibration-damping components. The support components include sliding rails vertically disposed at four inner corners of the box body. The sliding vibration-damping components include upper sliding blocks, lower sliding blocks, upper fixing blocks, and lower fixing blocks. A spring piece is disposed between each of the sliding blocks and a corresponding one of the fixing blocks. The placement assembly includes covering components and connecting components, the covering components include an upper film and a lower film which are oppositely disposed. The connecting components include first fasteners and second fasteners, the first fasteners are hinged with the upper sliding blocks respectively, and the second fasteners are hinged with the lower sliding blocks respectively.

9 Claims, 5 Drawing Sheets

LOGISTICS TRANSPORT BOX

TECHNICAL FIELD

The disclosure relates to the technical field of packaging boxes, in particular to a logistics transport box.

BACKGROUND

At present, during the transportation and use of packaging boxes, the atmospheric pressure difference between the inside of the packaging box and the external environment will change greatly with the change of the temperature and atmospheric pressure. In order to prevent precision instruments inside the packaging box from being damaged due to excessive pressure difference, the packaging box must have a certain pressure bearing capacity. Therefore, a pressure bearing test should be carried out after manufacturing the packaging box.

At present, for the transportation of small precision instruments or the transportation of electronic products having special requirements of logistics transportation (such as shockproof, moisture-proof, etc.), filling packaging is mostly used in these transportation while a few of these transportation will use a plastic film to cover the objects on the logistics package, the plastic film only plays a simple protective role, and the effect of the plastic film is not good to transfer and transportation of the objects. However, the filling packaging is common in the market, which is difficult to ensure the transportation hygiene and quality requirements of the objects to be transported. Especially for medical equipment or special equipment, the surfaces of the equipment need to be sterilized. The existing transportation logistics environment is easy to cause sanitary problems when objects leave the factory. In addition, the existing suspension-packaging for precision instruments or electronic products is simple and crude, and does not meet the transportation requirements for precision instruments or electronic products with high requirements.

SUMMARY

In view of this, a purpose of the disclosure is to provide a logistics transport box to solve the above problems.

The disclosure adopts following technical solutions.

The disclosure provides a logistics transport box which is suitable for packaging and transportation of objects. The logistics transport box includes a box body, a placement assembly, and an installation assembly. The box body is provided with a cover which is configured to expose an inner space of the box body after being opened. The placement assembly is configured to package and limit an object stored in the box body in a suspended manner. Specifically, the installation assembly is configured to provide vibration-damping and buffering along multiple degrees of freedom for the placement assembly. The installation assembly includes support components and sliding vibration-damping components. The support components include sliding rails vertically disposed at four inner corners of the box body, and the sliding rails include first sliding rails and second sliding rails. The sliding vibration-damping components include sliding blocks, fixing blocks, and spring pieces; the sliding blocks include upper sliding blocks slidably connected to the first sliding rails respectively and lower sliding blocks slidably connected to the second sliding rails respectively; the fixing blocks include upper fixing blocks configured to limit the upper sliding blocks to continuously slide upward respectively and lower fixing blocks configured to limit the lower sliding blocks to continuously slide downward respectively. Each of the spring pieces is disposed between each of the sliding blocks and a corresponding one of the fixing blocks, and configured to provide elastic buffering for the sliding block along a length direction of a corresponding one of the sliding rails. The placement assembly includes covering components and connecting components; the covering components include an upper film and a lower film which are oppositely disposed; the connecting components include fasteners composed of first fasteners and second fasteners, the first fasteners are configured to unload the upper film and the second fasteners are configured to unload the lower film, the first fasteners are hinged with the upper sliding blocks respectively, and the second fasteners are hinged with the lower sliding blocks respectively. The first fasteners define a first mounting plane for the upper film, and the second fasteners define a second mounting plane for the lower film, so that the object placed between the upper film and the lower film is covered and limited under cooperation of the upper film at the first mounting plane and the lower film at the second mounting plane, so as to avoid collision and contact between the object and an inner wall of the box body.

In an embodiment, the fasteners are connected to the sliding blocks through inclined rods respectively, the inclined rods include first inclined rods and second inclined rods, and two ends of each of the inclined rods are provided with universal hinged structures respectively.

In an embodiment, each of the first inclined rods is disposed between the first fastener and the upper sliding block, and each of the first inclined rods inclines downward from outside to inside.

In an embodiment, each of the second inclined rods is disposed between the second fastener and the lower sliding block, and each of the second inclined rods inclines upward from outside to inside.

In an embodiment, each of the four inner corners is provided with one of the first sliding rails matched with the upper sliding block and two of the second sliding rails matched with two of the lower sliding blocks, the first sliding rail and the two second sliding rails are arranged in a triangle, and the two second sliding rails are arranged on an outside relative to the first sliding rail.

In an embodiment, an upper part of the box body is provided with a 回-shaped plate having a top opening, and the 回-shaped plate is integrally formed with the box body. Specifically, the sliding rails are disposed between the 回-shaped plate and a bottom of the box body to limit positions of the support components and to support the box body.

In an embodiment, one of the first fasteners is configured to be connected to the second fastener located at a same side with the one first fastener; the first fasteners and the second fasteners are configured to limit the first mounting plane and the second mounting plane to be adjacent to each other, so that the upper film and the lower film are adjacent to each other to define a tight covering space; there is a space between the upper film and the inner wall of the box body, and there is a space between the lower film and the inner wall of the box body.

In an embodiment, each of the first fasteners is provided with a screw spinner, and each of the second fasteners is correspondingly provided with a joint part; the screw spinner is configured to be mounted on the joint part to connect the first fastener and the second fastener, thereby to make the first mounting plane and the second mounting plane be adjacent to each other.

In an embodiment, each of the upper fixing blocks is located at an upper part of the first sliding rail, and each of the lower fixing blocks is located at a lower part of the second siding rail; and the spring pieces are sleeved on the sliding rails respectively and disposed slidably between the sliding blocks and the fixing blocks respectively.

In an embodiment, the box body is made of a fiber composite material, each of the sliding rails has a steel frame structure; and the upper film and the lower film are silica gel films.

By adopting the above technical solutions, the disclosure can achieve the following technical effects.

1. Compared with the common filling packaging types in the market, the logistics transport box of the disclosure can significantly achieve the effect of recycling, significantly reduce the cost and environmental problems caused by the filling packaging, and also ensure the transportation hygiene and quality requirements of the object in the logistics transport box of the disclosure, especially suitable for the transportation of high-precision instruments and medical devices.

2. The installation assembly provides vibration-damping and buffering along multiple degrees of freedom for the placement assembly, so as to ensure that the object placed in the box body is suspended in the inner space. The support components and sliding vibration-damping components of the installation assembly can avoid the object contacting with the inner wall of the box body after the object is covered and limited by the covering components of the placement assembly, so as to achieve the purpose of vibration-damping and buffering, and the support components and sliding vibration-damping components of the installation assembly can also greatly reduce the damage to the object caused by bumping during transportation. Specifically, the object is placed between the upper film at the first mounting plane and the lower film at the second mounting plane to achieve the effect of suspension and anti-collision. In addition, under the premise of achieving a similar transportation effect, the logistics transport box of the disclosure has more obvious advantages in production cost and operability.

DESCRIPTION OF REFERENCE NUMERALS

Figure 1:
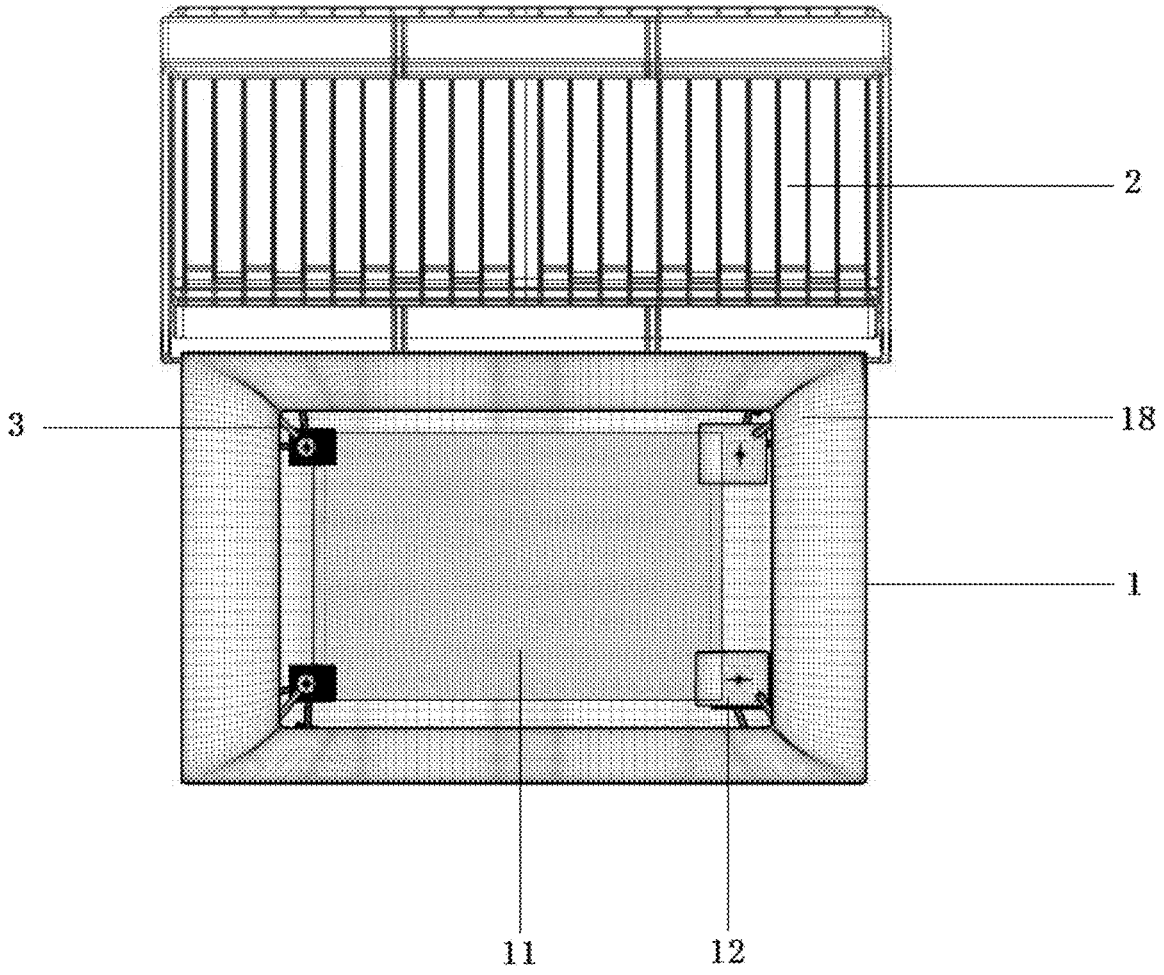
FIG. 1 is a schematic structural view of a logistics transport box in an embodiment of the disclosure, and a cover is in an open state to expose an inner space of a box body.
Figure 2:
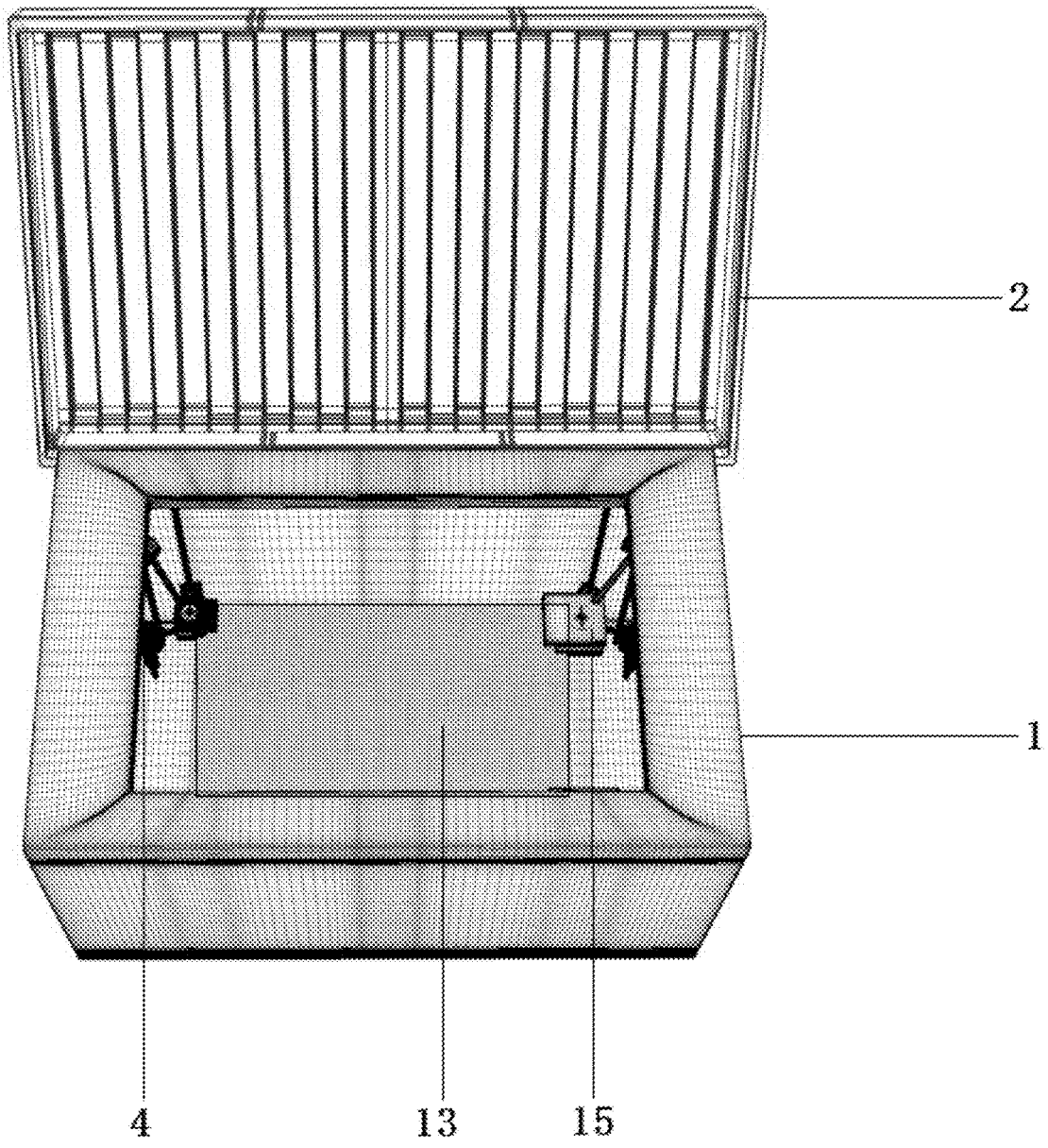
FIG. 2 is a schematic structural view of FIG. 1 in another view.
Figure 3:
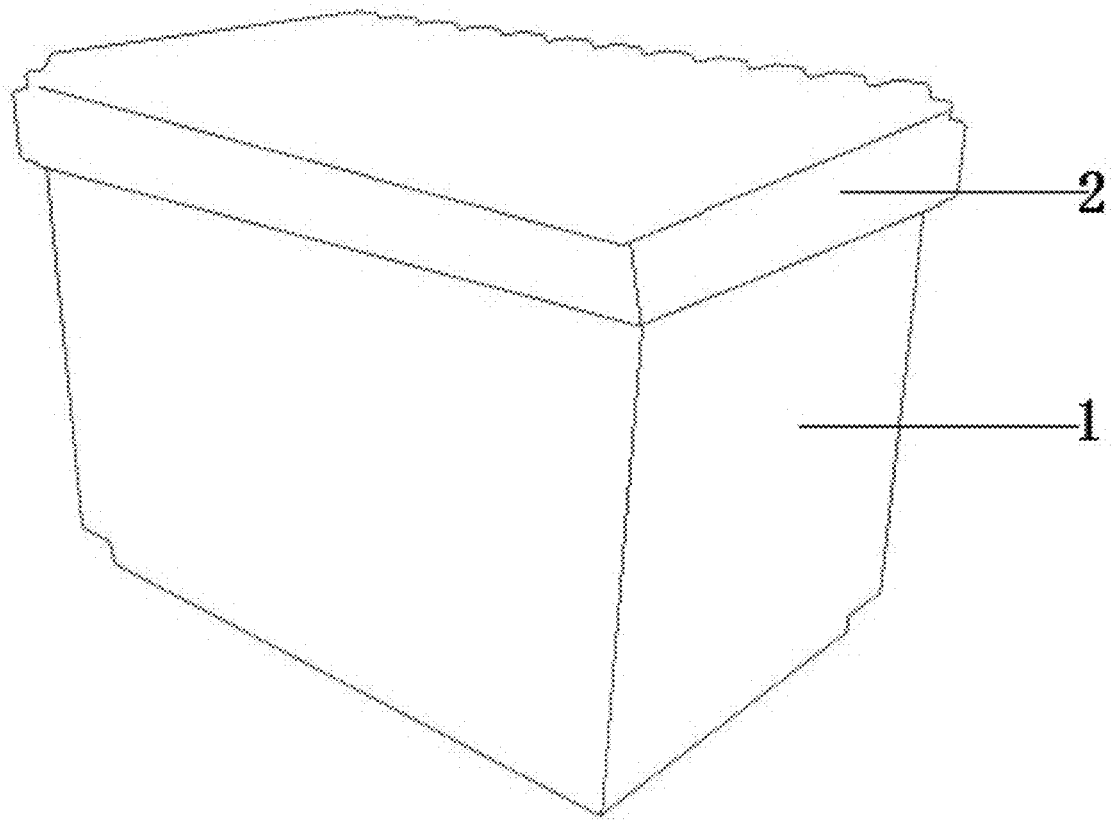
FIG. 3 is a structural schematic view of the cover in FIG. 1 in a closed state.

1—box body; 2—cover; 3—support component; 4—sliding vibration-damping component; 5—sliding rail; 51—first sliding rail; 52—second sliding rail; 6—upper sliding block; 7—lower sliding block; 8—upper fixing block; 9—lower fixing block; 10—piece; 11—covering component; 12—connecting component; 13—upper film; 14—lower film; 15—first fastener; 16—second fastener; 17—inclined rod; 171—first inclined rod; 172—second inclined rod; 18—回-shaped plate; 19—screw spinner; 20—part.

DETAILED DESCRIPTION OF EMBODIMENTS

In order to make the purpose, technical solutions, and advantages of the embodiments of the disclosure clearer, the technical solutions of the embodiments of the disclosure will be clearly and completely described below in combination with attached drawings in the embodiments. Apparently, the described embodiments are a part of but not all embodiments of the disclosure. All other embodiments obtained by those ordinary skilled in the art without creative work based on the embodiments of the disclosure should fall within the scope of protection of the disclosure. Therefore, the following detailed description of the embodiments of the disclosure provided in the attached drawings is not intended to limit the scope of protection of the disclosure, but is merely representative of selected embodiments of the disclosure. All other embodiments obtained by those ordinary skilled in the art without creative work based on the embodiments of the disclosure should fall within the scope of protection of the disclosure.

Embodiment

As shown in FIG. 1 to FIG. 7, the embodiment provides a logistics transport box which is suitable for packaging and transportation of objects. The logistics transport box includes a box body 1, a placement assembly, and an installation assembly. The box body 1 is provided with a cover 2 which is configured to expose an inner space of the box body 1 after being opened. The placement assembly is configured to package and limit an object stored in the box body 1 in a suspended manner. The installation assembly is configured to provide vibration-damping and buffering along multiple degrees of freedom for the placement assembly.

Specifically, the installation assembly includes support components 3 and sliding vibration-damping components 4. The support components 3 include sliding rails 5 vertically disposed at four inner corners of the box body 1, and the sliding rails 5 include first sliding rails 51 and second sliding rails 52. The sliding vibration-damping components include sliding blocks, fixing blocks, and spring pieces 10; the sliding blocks include upper sliding blocks 6 slidably connected to the first sliding rails 51 respectively and lower sliding blocks 7 slidably connected to the second sliding rails 52 respectively; the fixing blocks include upper fixing blocks 8 configured to limit the upper sliding blocks 6 to continuously slide upward respectively and lower fixing blocks 9 configured to limit the lower sliding blocks 7 to continuously slide downward respectively. Each of the spring pieces 10 is disposed between each of the sliding blocks and a corresponding one of the fixing blocks, and configured to provide elastic buffering for the sliding block along a length direction of a corresponding one of the sliding rails 5.

The placement assembly includes covering components 11 and connecting components 12; the covering components 12 include an upper film 13 and a lower film 14 which are oppositely disposed; the connecting components 12 include fasteners composed of first fasteners 15 and second fasteners 16, the first fasteners 15 are configured to unload the upper film 13 and the second fasteners 16 are configured to unload the lower film 14, the first fasteners 15 are hinged with the upper sliding blocks 6 respectively, and the second fasteners 16 are hinged with the lower sliding blocks 7 respectively. The first fasteners 15 define a first mounting plane for the upper film 13, the second fasteners 16 define a second mounting plane for the lower film 14, so that the object placed between the upper film 13 and the lower film 14 is covered and limited under cooperation of the upper film 13 at the first mounting plane and the lower film 14 at the second mounting plane, so as to avoid collision and contact between the object and an inner wall of the box body 1.

Compared with the common filling packaging types in the market, the logistics transport box in the disclosure can significantly achieve the effect of recycling, significantly reduce the cost and environmental problems caused by the filling packaging, and also ensure the transportation hygiene and quality requirements of the object in the box body 1, especially suitable for the transportation of high-precision instruments and medical devices.

In the embodiment, the installation assembly implements multiple degrees of freedom of vibration-damping and buffering for the placement assembly, so as to ensure that the object placed in the box body 1 is suspended in the inner space. Specifically, the support components 3 and sliding vibration-damping components 4 of the installation assembly can avoid the object contacting with the inner wall of the box body 1 after the object is covered and limited by the covering components 11 of the placement assembly, so as to achieve the purpose of vibration-damping and buffering, and the support components 3 and sliding vibration-damping components 4 of the installation assembly can also greatly reduce the damage to the object caused by bumping during transportation. Specifically, the object is placed between the upper film 13 at the first mounting plane and the lower film 14 at the second mounting plane to achieve the effect of suspension and anti-collision. In addition, under the premise of achieving a similar transportation effect, the logistics transport box in the disclosure have more obvious advantages in production cost and operability.

Figure 4:
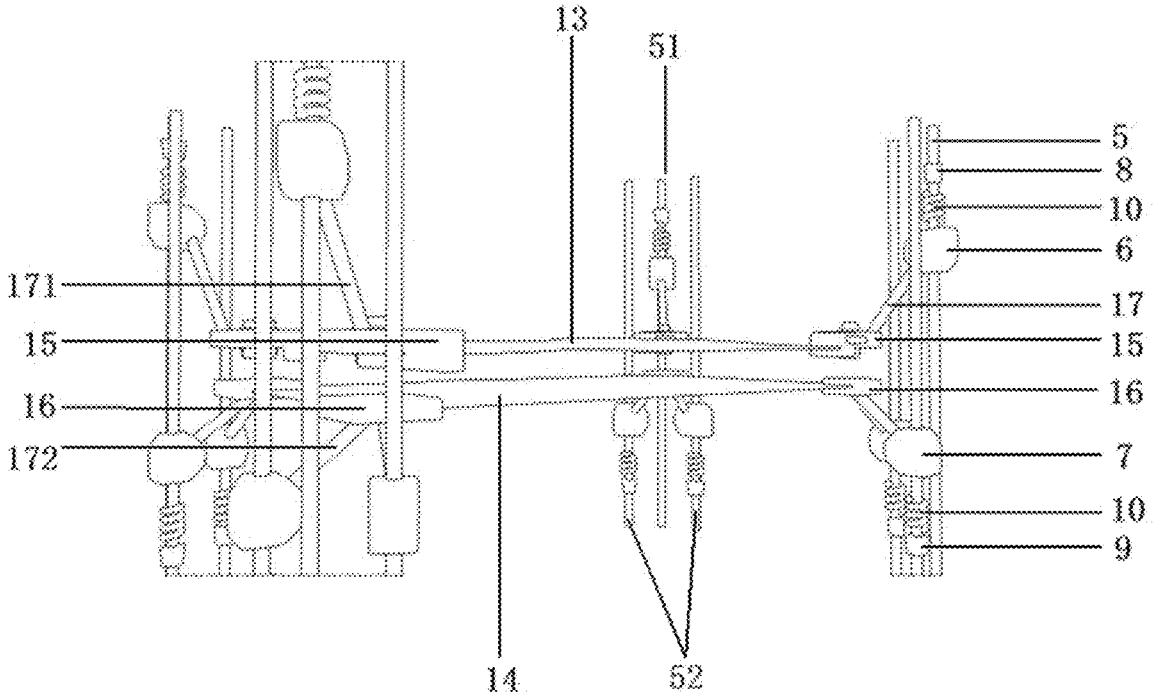
FIG. 4 is a structural schematic view in the inner space of the logistics transport box in the embodiment of the disclosure, in which a part of the inner space is cut in a height direction for convenience of showing, as shown in the FIG. 4.
Figure 5:
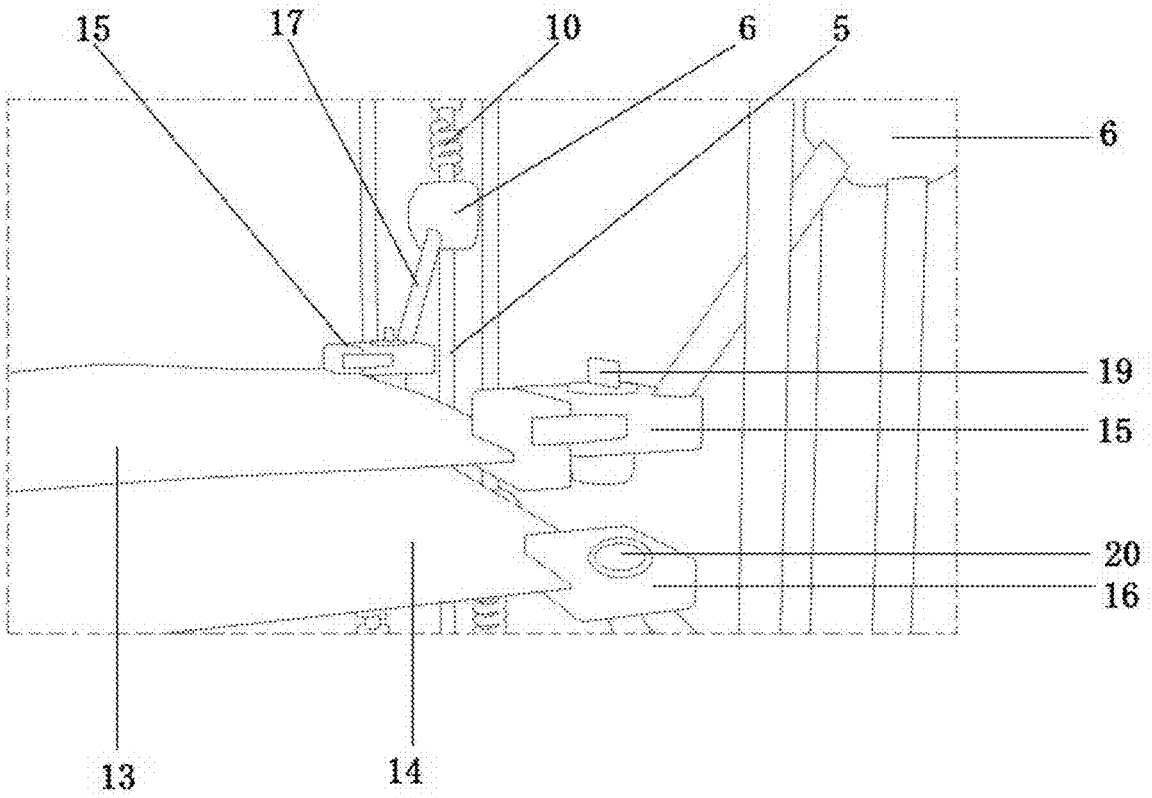
FIG. 5 is a partial enlarged schematic view of the logistics transport box in the embodiment of the disclosure.

As shown in FIG. 4 and FIG. 5, the fasteners are connected to the sliding blocks through inclined rods 17 respectively, the inclined rods 17 include first inclined rods 171 and second inclined rods 172, and two ends of each of the inclined rods 17 are provided with universal hinged structures respectively. Therefore, the inclined rods 17 are configured to enhance the free movement of the upper film 13 and the lower film 14 along multiple directions in the box body 1, so as to realize the suspension swing of the object along multiple degrees of freedom in the up and down directions, left and right directions, and front and rear directions, and the object does not contact with the inner wall of the box body 1 in any directions. This design significantly improves the suspension and vibration-damping requirements of the object during transportation.

It is obvious that the universal hinged structure of the inclined rods 17 can be connected to the fasteners and the sliding blocks in the way of ball joint hinge, and the connection method of the universal hinged structure of the inclined rods 17 in the disclosure is not limited herein.

In the embodiment, each of the first inclined rods 171 is disposed between the first fastener 15 and the upper sliding block 6, and each of the first inclined rods 171 inclines downward from outside to inside. Correspondingly, each of the second inclined rods 172 is disposed between the second fastener 16 and the lower sliding block 7, and each of the second inclined rods 172 inclines upward from outside to inside. Specifically, for each of the four inner corners of the box body 1, the inclined rods 17 are connected to the upper film 13 and the lower film 14, and the upper film 13 is connected to one of the inclined rods 17 (i.e., one of the first inclined rods 171), and the lower film 14 is butted with two of the inclined rods 17 (i.e., two of the second inclined rods 172). The three inclined rods work together to define a stable support limit for the object between the upper film 13 and the lower film 14, and to improve the tight fit between the placement assembly and the installation assembly.

Furthermore, each of the four inner corners is provided with one of the first sliding rails 51 matched with the upper sliding block 6 and two of the second sliding rails 52 matched with two of the lower sliding blocks 7, the first sliding rail 51 and the two second sliding rails 52 are arranged in a triangle, and the two second sliding rails 52 are arranged on an outside relative to the first sliding rail 51. Therefore, for each of the four inner corners, the sliding rail 5 (i.e., the first sliding rail 51) disposed in a middle is provided with the first inclined rod 171 connected between the upper sliding block 6 and the first fastener 15, and the two sliding rails 5 (i.e., the second sliding rails 52) disposed at two sides are provided with two of the second inclined rods 172 connected between the lower sliding blocks 7 and the second fasteners 16, so as to define a stable triangular support and installation limit.

Furthermore, an upper part of the box body 1 is provided with a 回-shaped plate 18 having a top opening, and the 回-shaped plate 18 is integrally formed with the box body 1; and the sliding rails 5 are disposed between the 回-shaped plate 18 and a bottom of the box body 1 to limit positions of the support components 3 and to support the inner space of the box body 1. Through a support space defined at corners between the 回-shaped plate 18 disposed at the upper part of the box body 1 and the bottom of the box body 1, the sliding rails 5 are fixed detachably to achieve a purpose of installing and limiting the placement assembly and a purpose of supporting the box body 1 stably.

Figure 6:
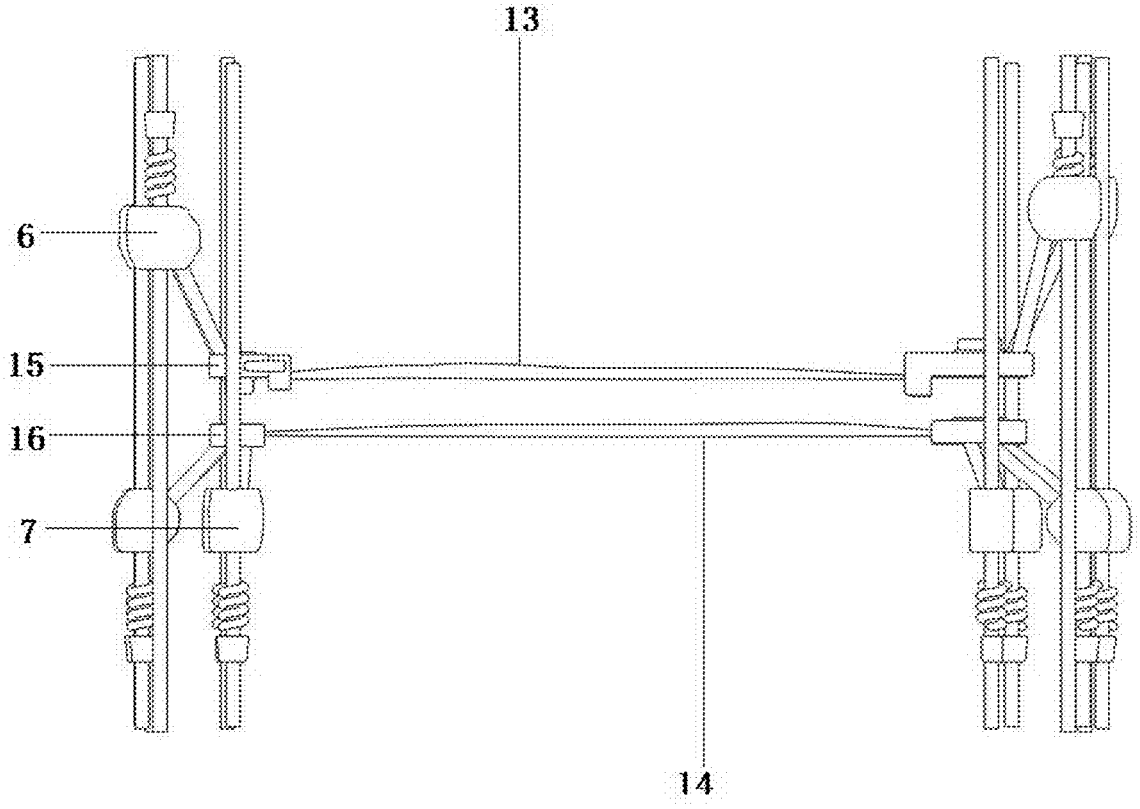
FIG. 6 and FIG. 7 are structural schematic views of the logistics transport box in the embodiment of the disclosure before and after upper and lower fasteners are matched with each other.
Figure 7:
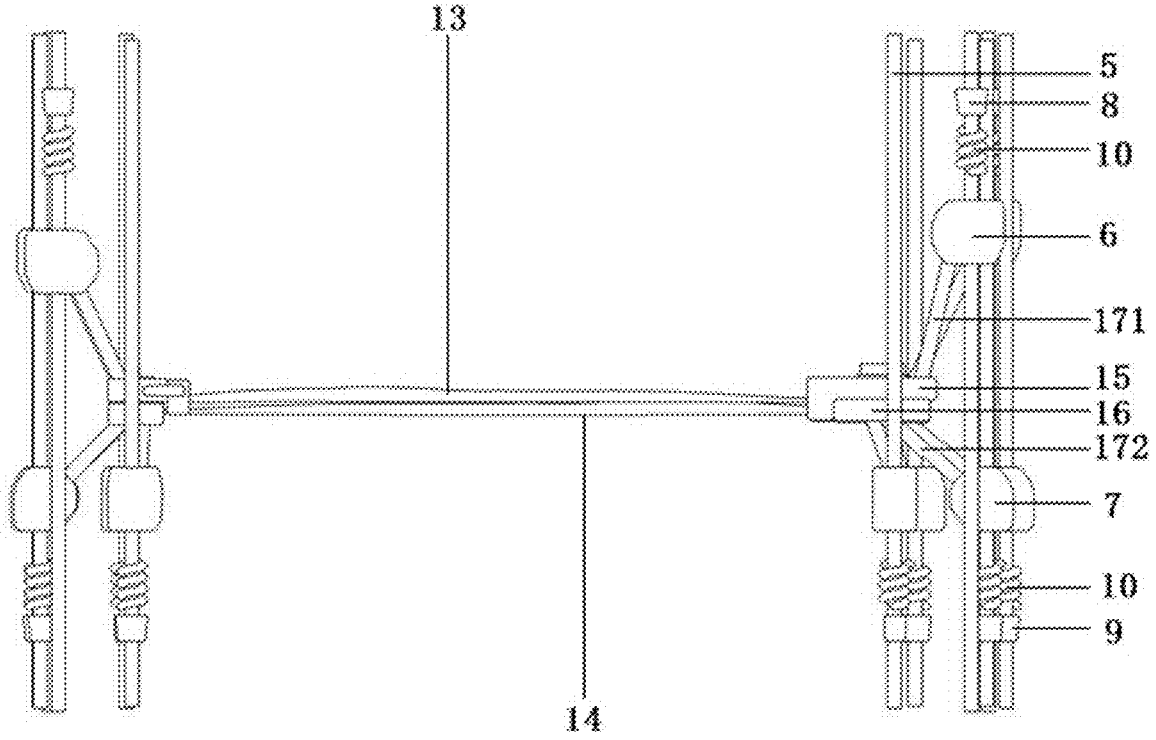

As shown in FIG. 6 and FIG. 7, in the embodiment, one of the first fasteners 15 is connected to the second fastener 16 located at a same side with the one first fastener 15; the first fasteners 15 and the second fasteners 16 are configured to limit the first mounting plane and the second mounting plane to be adjacent to each other, so that the upper film 13 and the lower film 14 are adjacent to each other to define a covering space; and there is a space for movement between each of the films (i.e., the upper film 13 and the lower film 14) and the inner wall of box body 1. Specifically, the first fastener 15 and the second fastener 16 are connected to each other in alignment, so that the upper film 13 and the lower film 14 are adjacent to each other, and the object placed between the films are further tightly covered and fixed in the placement assembly to avoid movement and other situations.

It should be understood that for the placement operation of object between the films, the lower film 14 can be assembled at the second mounting plane firstly, and then the object can be directly placed on the lower film 14, and then the upper film 13 can be assembled at the first mounting plane, and finally the first fastener and the second fastener 16 can be connected to each other to realize the packaging and suspending of the object.

In other embodiments, the placement of the object can also be realized by directly placing the object from a side between the upper film 13 and the lower film 14, and finally connecting the first fastener 15 and the second fastener 16.

As shown in FIG. 5 and FIG. 7, in the embodiment, each of the first fasteners 15 is provided with a screw spinner 19, and each of the second fasteners 16 is correspondingly provided with a joint part 20; the screw spinner 19 is configured to be mounted on the joint part 20 to connect the first fastener 15 and the second fastener 16, thereby to make the first mounting plane and the second mounting plane be adjacent to each other. Therefore, the first fastener 15 and second fastener 16 are screwed together form a whole, which improves the effect of packaging between the films.

In the embodiment, each of the upper fixing blocks 8 is located at an upper part of the first sliding rail 51, and each of the lower fixing blocks 9 is located at a lower part of the second siding rail; and the spring pieces 10 are sleeved on the sliding rails 5 respectively and disposed slidably between the sliding blocks and the fixing blocks respectively. Specifically, two ends of each of the spring pieces 10 are in a free state, and are not limited by the fixing block and the sliding block. Only when the sliding block is upward or downward close to the corresponding fixing block, the spring piece 10 is elastically pressed to provide the effect of vibration-damping and buffering in a vertical direction.

It should be noted that the box body 1 is made of a fiber composite material, each of the sliding rails 5 is a steel frame structure; and both the upper film 13 and the lower film 14 are silica gel films. Specifically, the carbon fiber composite material can improve the structural strength of the box body 1, and the carbon fiber composite material is light in weight and easy to be transferred. In addition, all the sliding rails 5 and the inclined rods 17 are steel frame structures, the fasteners, the sliding blocks and the fixing blocks are made of plastic materials to improve the practicability and stability of the overall. In addition, the upper film 13 and the lower layer film 14 made of silica gel are easy to be produced, reusable, and have better packaging effect.

The above are only a part of embodiments of the disclosure. The scope of protection of the disclosure is not limited to the above embodiments. All technical solutions under the idea of the disclosure should belong to the scope of protection of the disclosure.

What is claimed is:

1. A logistics transport box, comprising:

a box body, provided with a cover which is configured to expose an inner space of the box body after being opened;

a placement assembly, configured to package and limit an object stored in the box body in a suspended manner; and an installation assembly, configured to provide vibration-damping and buffering along a plurality of degrees of freedom for the placement assembly;

wherein the installation assembly comprises support components and sliding vibration-damping components; the support components comprise sliding rails vertically disposed at four inner corners of the box body; and the sliding rails comprise first sliding rails and second sliding rails;

wherein the sliding vibration-damping components comprise sliding blocks, fixing blocks, and spring pieces; and the sliding blocks comprise:

upper sliding blocks, slidably connected to the first sliding rails respectively; and lower sliding blocks, slidably connected to the second sliding rails respectively;

wherein the fixing blocks comprise:

upper fixing blocks, configured to limit the upper sliding blocks to continuously slide upward respectively; and lower fixing blocks, configured to limit the lower sliding blocks to continuously slide downward respectively;

wherein each of the spring pieces is disposed between each of the sliding blocks and a corresponding one of the fixing blocks, and configured to provide elastic buffering for a corresponding sliding block of the sliding blocks along a length direction of a corresponding one of the sliding rails;

wherein the placement assembly comprises covering components and connecting components; the covering components comprise an upper film and a lower film which are oppositely disposed; the connecting components comprise fasteners composed of first fasteners and second fasteners, the first fasteners are configured to unload the upper film and the second fasteners are configured to unload the lower film, the first fasteners are hinged with the upper sliding blocks respectively, and the second fasteners are hinged with the lower sliding blocks respectively; the first fasteners define a first mounting plane for the upper film, the second fasteners define a second mounting plane for the lower film, so that the object placed between the upper film and the lower film is covered and limited under cooperation of the upper film at the first mounting plane and the lower film at the second mounting plane, so as to avoid collision and contact between the object and an inner wall of the box body.

2. The logistics transport box according to claim 1, wherein the fasteners are connected to the sliding blocks through inclined rods respectively, the inclined rods comprise first inclined rods and second inclined rods, and two ends of each of the inclined rods are provided with universal hinged structures respectively.

3. The logistics transport box according to claim 2, wherein each of the first inclined rods is disposed between a corresponding first fastener of the first fasteners and a corresponding upper sliding block of the upper sliding blocks, and each of the first inclined rods inclines downward from outside to inside.

4. The logistics transport box according to claim 3, wherein each of the second inclined rods is disposed between a corresponding second fastener of the second fasteners and a corresponding lower sliding block of the lower sliding blocks, and each of the second inclined rods inclines upward from outside to inside.

5. The logistics transport box according to claim 4, wherein each of the four inner corners is provided with one of the first sliding rails matched with the upper sliding block and two of the second sliding rails matched with two of the lower sliding blocks, the first sliding rail and the two second sliding rails are arranged in a triangle, and the two second sliding rails are arranged on an outside relative to the first sliding rail.

6. The logistics transport box according to claim 1, wherein one of the first fasteners is configured to be connected to a corresponding second fastener of the second fasteners located at a same side with the one first fastener; the first fasteners and the second fasteners are configured to limit the first mounting plane and the second mounting plane to be adjacent to each other, so that the upper film and the lower film are adjacent to each other to define a covering space; there is a space between the upper film and the inner wall of the box body, and there is a space between the lower film and the inner wall of the box body.

7. The logistics transport box according to claim 6, wherein each of the first fasteners is provided with a screw spinner, and each of the second fasteners is correspondingly provided with a joint part; the screw spinner is configured to be mounted on the joint part to connect a corresponding first fastener of the first fasteners and a corresponding second fastener of the second fasteners, thereby to make the first mounting plane and the second mounting plane be adjacent to each other.

8. The logistics transport box according to claim 1, wherein each of the upper fixing blocks is located at an upper part of a corresponding first sliding rail of the first sliding rails, and each of the lower fixing blocks is located at a lower part of a corresponding second sliding rail of the second sliding rails; and the spring pieces are sleeved on the sliding rails respectively.

9. The logistics transport box according to claim 1, wherein the box body is made of a fiber composite material, each of the sliding rails has a steel frame structure; and the upper film and the lower film are silica gel films.

* * * * *